US011541661B2

(12) United States Patent
Koehler

(10) Patent No.: US 11,541,661 B2
(45) Date of Patent: Jan. 3, 2023

(54) ALIGNMENT CIRCUITS

(71) Applicant: Hewlett-Packard Development Company, L.P., Spring, TX (US)

(72) Inventor: Duane A Koehler, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 302 days.

(21) Appl. No.: 17/049,482

(22) PCT Filed: Jul. 13, 2018

(86) PCT No.: PCT/US2018/042097
§ 371 (c)(1),
(2) Date: Oct. 21, 2020

(87) PCT Pub. No.: WO2020/013861
PCT Pub. Date: Jan. 16, 2020

(65) Prior Publication Data

US 2021/0046758 A1 Feb. 18, 2021

(51) Int. Cl.
*B41J 2/175* (2006.01)

(52) U.S. Cl.
CPC ..... *B41J 2/17506* (2013.01); *B41J 2/1752* (2013.01)

(58) Field of Classification Search
CPC .... B41J 2/175; B41J 2/17506; B41J 2/17509; B41J 2/1752; B41J 2/1753; B41J 2/17546
See application file for complete search history.

(56) References Cited

U.S. PATENT DOCUMENTS

| | | | | |
|---|---|---|---|---|
| 5,475,403 | A | 12/1995 | Havlovick et al. | |
| 5,903,285 | A | 5/1999 | Ju et al. | |
| 7,484,837 | B2 * | 2/2009 | Koga | B41J 2/17509 347/85 |
| 9,302,486 | B2 | 4/2016 | Nie | |
| 9,889,672 | B2 * | 2/2018 | Kobayashi | B41J 2/17523 |
| 2005/0157124 | A1 | 7/2005 | Silverbrook | |
| 2009/0079804 | A1 | 3/2009 | Kimura | |
| 2016/0059574 | A1 | 3/2016 | Saikawa | |
| 2017/0259577 | A1 | 9/2017 | Wang et al. | |

FOREIGN PATENT DOCUMENTS

| | | | |
|---|---|---|---|
| CN | 101887233 | A | 11/2010 |
| CN | 1990255 | B | 5/2012 |
| CN | 203282858 | U | 11/2013 |
| DE | 202018102465 | U1 | 5/2018 |
| EP | 3001316 | A4 | 1/2018 |
| JP | 2001-142553 | A | 5/2001 |
| JP | 2007152681 | | 6/2007 |
| JP | 2010-241098 | A | 10/2010 |

* cited by examiner

*Primary Examiner* — Anh T Vo
(74) *Attorney, Agent, or Firm* — Brooks, Cameron & Huebsch, PLLC

(57) ABSTRACT

In some examples an imaging device can include a fill port to receive a colorant container including an alignment circuit, a controller including a processing resource and memory resource including a non-transitory computer-readable instructions executable by the processing resource to detect a presence of a colorant container in a fill port of an imaging device, responsive to detection of the colorant container in the fill port, detect if the colorant container is properly inserted in the fill port, and cause a fill process to initiate responsive to detection that the colorant container is properly inserted.

15 Claims, 3 Drawing Sheets

ALIGNMENT CIRCUITS

BACKGROUND

Imaging systems, such as printers, copiers, etc., may be used to form markings on a physical medium, such as text, images, etc. Imaging systems may form markings on the physical medium by transferring a print substance (e.g., ink, toner, etc.) to the physical medium.

DETAILED DESCRIPTION

Figure 1:
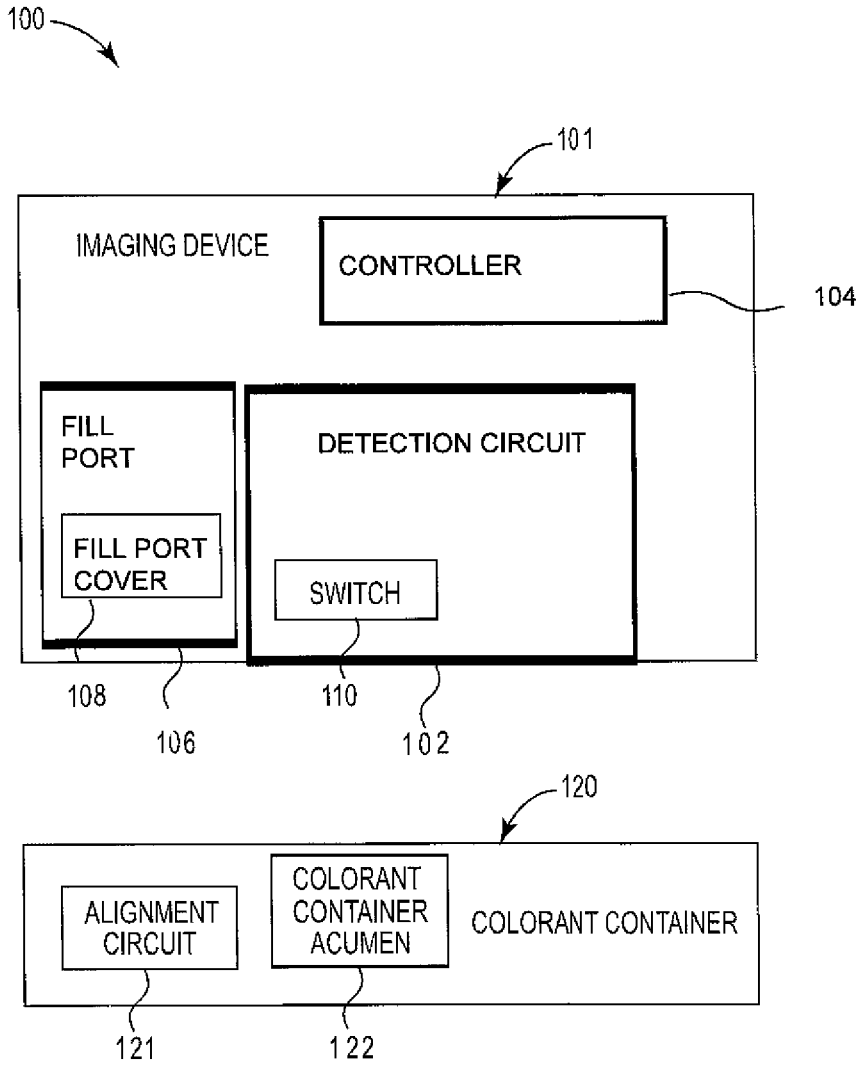
FIG. 1 illustrates an alignment system consistent with the disclosure.

Imaging devices may include an amount of a print substance in a reservoir. As used herein, the term "reservoir" refers to a container, a tank, and/or a similar vessel having a volume to store an amount of print substance for use by an imaging device. As used herein, the term "imaging device" refers to a hardware device with functionalities to a physically produce representation(s) of text, images, models, etc. on a physical medium. Examples of imaging devices include ink/toner printers and/or three-dimensional printers, among other types of imaging devices.

An imaging device may use a print substance in the reservoir to create text, images, etc. on a physical medium. Examples of physical medium include paper, photopolymers, plastics, composite, metal, wood, among other types of physical mediums. However, the reservoir may have a finite amount of print substance in a volume of the reservoir at a given time. The amount of print substance in the reservoir may be reduced during operation of the imaging device, for instance, due to application of print substance from the reservoir to a physical medium. At some point, an amount of colorant in the reservoir may be less than a threshold amount of colorant for the imaging device to operate as intended.

As such, the reservoir may be filled/refilled to provide/maintain an amount of print substance in the reservoir that is greater than the threshold amount of print substance. For instance, some approaches employ a colorant container. As used herein, the term "colorant container" may refer to a vessel, bottle, bag, box, carton, or other suitable receptacle for the transfer and/or containment of a print substance from the colorant container to the imaging device. However, an improperly positioned colorant container may lead to inadvertent spillage of a print substance when commencing and/or ending a refill process.

Accordingly, the disclosure is directed to alignment circuits. For example, an imaging device may include a fill port to receive a colorant container including an alignment circuit, a controller including a processing resource and memory resource including a non-transitory computer-readable instructions executable by the processing resource to detect a presence of a colorant container in a fill port of an imaging device; responsive to detection of the colorant container in the fill port, detect if the colorant container is properly inserted in the fill port and cause a fill process to initiate responsive to detection that the colorant container is properly inserted. That is, alignment circuits may permit determination if a colorant container is properly positioned in a refill port to commence or end a refill process. As used herein, the term "properly inserted" refers to a determined amount of voltage and/or current across a resistive element coupled to a colorant container acumen being greater than a threshold amount of voltage and/or current for a predetermined amount of time. Conversely, as used herein the term "improperly inserted" refers to a determined amount of voltage and/or current across a resistive element coupled to a colorant container acumen being less than a threshold amount of voltage and/or current for a predetermined amount of time.

FIG. 1 illustrates an alignment system 100 consistent with the disclosure. As illustrated in FIG. 1, the alignment system 100 may include an imaging device 101 and a colorant container 120.

The imaging device 101 may include a detection circuit 102, a controller 104, a fill port 106 having a fill port cover 108, and a switch 110. However, an imaging device may include additional components such as those detailed herein or may include fewer components (e.g., may be without a fill port cover, etc.). Moreover, while FIG. 1 illustrates an individual fill port cover, fill port, switch, detection circuit, and controller a total number of fill port covers, fill ports, switches, detection circuits, and/or controllers may be varied as may a relative location of such components. The imaging device 101 may be coupled to the colorant container 120, as described herein.

The detection circuit 102 may detect a status of the fill port 106. As used herein, the term "detection circuit" refers to an electrical circuit that may to determine a fill port status. As used herein, the term "fill port status" refers to a condition of the fill port. The condition of the fill port may include being open or being closed. The fill port may be closed via a fill port cover or via a colorant container being connected to the fill port. The detection circuit 102 may include a mechanical and/or electronic switch electrically connected at each fill port to detect if a fill port is open (e.g., without either of a fill port cover or a colorant container) or closed (e.g., by a fill port cover or a colorant container connected thereto).

The fill port 106 may be used to fill and/or refill a reservoir with a print substance that may be utilized by the imaging device 101. Although not shown in FIG. 1, the imaging device 101 may include a corresponding reservoir connected to the fill port 106.

As illustrated in FIG. 1, the fill port 106 may include a fill port cover 108. The fill port cover 108 may cover a fill port such that the print substance included in a reservoir connected to the fill port does not evaporate and/or become contaminated. However, to perform a fill operation for the reservoir, the fill port cover 108 may be removed/opened to expose a fill port such as fill port 106. For example, during a fill operation as print substance included in a reservoir is utilized by imaging device 101, the amount of print substance included in the reservoir may be depleted. During a fill operation (e.g., the activity of a user or machine filling the reservoir with a print substance), a user may open a fill port cover to expose the fill port 106.

When the fill port cover 108 is opened/removed to expose the fill port 106, switch 110 which is connected to the fill port cover 108 may be opened. As used herein, the term "switch" refers to an electrical-mechanical component that may interrupt an electrical circuit, such as interrupting a current in the electrical circuit and/or diverting the current from one component to another. For example, when the fill port cover 108 of the fill port 106 is opened, switch 110 corresponding to fill port 106 may be opened, causing a change in the state of the switch 110. As used herein, the term "switch state" refers to a condition of the switch. A condition of the switch 110 may include an open switch state or a closed switch state. As used herein, the term "open state" refers to a condition in which the switch has interrupted a current in the electrical circuit including the switch. As used herein, the term "closed state" refers to a condition in which current may pass through the electrical circuit including the switch. For example, when the fill port cover of fill port 106 is opened, the switch 110 may change from closed (e.g., in which current is flowing through switch 110) to open (e.g., in which switch 110 interrupts a flow of current to fill port 106).

As described above, the switch state of switch 110 may be closed when a fill port cover of fill port 106 is closed, protecting the print fluid in the reservoir connected to fill port 106 from evaporating or from contaminant introduction. However, examples of the disclosure are not so limited. For example, the switch state of switch 110 may be closed when a colorant container such as colorant container 120 is connected to fill port 106.

The colorant container 120 may be used to fill or refill a reservoir connected to the fill port. As mentioned, the term "colorant container" may refer to a vessel, bottle, bag, box, carton, or other suitable receptacle for the transfer and/or containment of a print substance.

The colorant container may include an alignment circuit 121 and a container acumen 122. As used herein, the term "alignment circuit" refers to an electrical circuit which may be utilized to determine whether a colorant container is properly inserted in a fill port. Thus, in contrast to other approaches (e.g., those having protrusions/holes to ensure a particular (e.g., yellow) colorant container is coupled to a corresponding refill port (e.g., a refill port coupled to a yellow print substance reservoir)), alignment circuits herein may ensure a colorant container is properly inserted to commence or end a refill process and therefore avoid inadvertent spillage of the print substance as detailed above. Examples of suitable alignment circuits are described in greater detail with respect to FIGS. 2-4. For instance, the alignment circuit 121 may permit determination of proper insertion of the colorant container in the fill port responsive to detection of the presence of the colorant container in the fill port, as detailed above As mentioned, the colorant container 120 may include a colorant container acumen 122. As used herein, the term "colorant container acumen" refers to a memory resource, such as those detailed herein, which may be coupled to a colorant container. For example, colorant container acumen 122 may be attached to colorant container 120 and include information related to the contents, manufacturing, etc. of the colorant container 120. Such information may be provided to the imaging device 101 via a data connection (not illustrated). In some examples, such a data connection may be formed responsive to determining a colorant container is properly inserted in a fill port.

Figure 2:
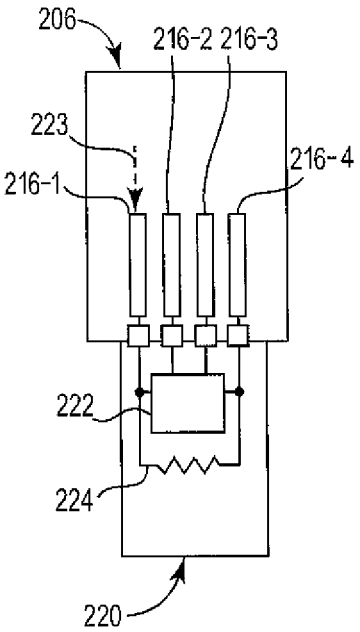
FIG. 2 illustrates an example of an alignment circuit consistent with the disclosure.

FIG. 2 illustrates an example of an alignment circuit consistent with the disclosure. As illustrated in FIG. 2, a fill port 206 may include a plurality of contacts 216-1, 216-2, 216-3, 216-4 (referred to collectively as contacts 216). As used herein, the term "contacts" refers to an electrical circuit component comprising an electrically conductive material such that the material may communicatively couple to another electrical circuit component. As used herein, the term "communicatively coupled" refers to various wired and/or wireless connections between devices such that data and/or signals may be transferred in various directions between the devices.

Colorant container 220 may include colorant container acumen 222. The colorant container 220 may be analogous or similar to the colorant containers 120, 320, and 420 as described herein with respect to FIGS. 1, 3, and 4, respectively. The colorant container acumen 222 may be analogous or similar to the colorant container acumens 122, 322, and 422 as described herein with respect to FIGS. 1, 3, and 4, respectively. As illustrated in FIG. 2, colorant container 220 may be connected to fill port 206 and colorant container acumen 222 may be connected to electrical contacts 216.

In some examples a detection circuit may include a sense resistor (not illustrated) among other circuitry such as an analog-to-digital converter to detect a presence of a colorant container in a fill port of an imaging device, as described herein. As used herein, the term "sense resistor" refers to a resistor placed in a current path to allow the current to be measured. More generally, as used herein, the term "resistor" refers to an electrical component of a circuit that engenders electrical resistance (e.g., to resist or reduce current flow).

Although not illustrated in FIG. 2 for clarity and so as not to obscure examples of the disclosure, fill port 206 may be electrically connected to a switch such as those described herein. In the example illustrated in FIG. 2, the switch may be in a closed state. In other words, current may flow between the electrical contact 216-1, a bias resistor 224, electrical contact 216-4, and the switch. In the closed state illustrated in FIG. 2, a controller (e.g., controller 104 and/or controller 504 described in connection with FIGS. 1 and 5, respectively) may determine that the fill port 206 is in a closed state via a colorant container 220 being connected to the fill port 206. That is, a detection circuit to permit detection, via a switch, of a presence of a colorant container in the fill port of an imaging device.

Similarly, an alignment circuit to permit determination of proper insertion of the colorant container in the fill port responsive to detection of the presence of the colorant container in the fill port. For instance, a controller (not illustrated in FIG. 2) may include instructions executable to detect, via an alignment circuit, that a colorant container is properly inserted in a fill port of an imaging device based on an amount of current or voltage of a signal (represented by element identifier 223) passing through the alignment circuit. Examples of suitable signals include those on a clock line, a data line, or other type of signal such as an amount of current and/or voltage on a power input line. Thus, if the amount of voltage (generated by current passing through a resistive element such as a bias resistor, and/or a ground loop-back circuit) is greater than a threshold amount of voltage the controller may determine that the colorant container is properly inserted in the fill port of the imaging device. However, if the amount of voltage is less than a threshold amount of voltage the controller may determine that the colorant container is improperly inserted in the fill port of the imaging device. The threshold amount may vary, for instance depending on a resistance (e.g., 2000 ohms, 200 ohms, etc.) of the alignment circuit and/or based on a type of alignment circuit (e.g., a bias resistor, a ground loop-back circuit, etc.), among other possibilities.

In some examples, the controller may include instructions to determine the colorant container is properly inserted if the determined voltage is above the threshold voltage for a predetermined amount of time (e.g., two seconds, once second, etc.). Having such a threshold amount of time may avoid false positives where the colorant container is inserted and exceeds a threshold amount of voltage and/or current momentarily but is not properly inserted so the voltage and/or current is less than the threshold amount. That is, in some examples, the controller may include instructions to determine the colorant container is improperly inserted if the determined voltage is above the threshold voltage for a duration of time that is less than a predetermined amount of time.

Figure 3:
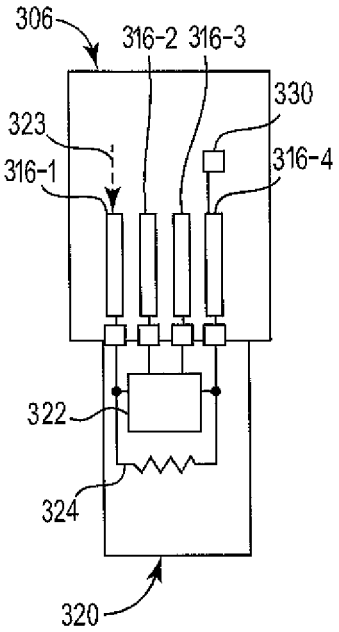
FIG. 3 illustrates another example of an alignment circuit consistent with the disclosure.

FIG. 3 illustrates another example of an alignment circuit consistent with the disclosure. Fill port 306 may be analogous or similar to fill ports 106, 206, 406 as described herein with respect to FIGS. 1, 2, and 4. For instance, the fill port 306 may include a plurality of contacts 316-1, 316-2, 316-3, 316-4 (referred to collectively as contacts 316).

As mentioned and as illustrated in FIG. 3, in some examples an alignment circuit may include a bias resistor 324 coupled to a colorant container acumen 322 in a colorant container 320. As used herein, the term "bias resistor" refers to a resistor placed in a current path to allow a baseline amount of current to flow along the current path and permit the current and/or voltage to be determined as described herein. The bias resistor 324 may have a predetermined resistance (e.g., 200 ohms) of any suitable value to promote alignment circuits, as described herein.

Although not illustrated in FIG. 3 for clarity and so as not to obscure examples of the disclosure, fill port 306 may be electrically connected to a switch such as those described herein. In the example illustrated in FIG. 3, the switch may be in a closed state. In other words, current may flow between the electrical contact 316-1, a bias resistor 324, electrical contact 316-4, and the switch. In the closed state illustrated in FIG. 3, a controller (e.g., controller 104 and/or controller 504 described in connection with FIGS. 1 and 5, respectively) may determine that the fill port 306 is in a closed state via a colorant container 320 being connected to the fill port 306. That is, a detection circuit to permit detection, via a switch, of a presence of a colorant container in the fill port of an imaging device. In some examples, the fill port 306 may include a visual indicator 330. Visual indicator 330 is analogous or similar to visual indicator 430, as detailed herein with respect to FIG. 4. While illustrated being located on the fill port it is understood that a visual indicator may be at various other locations (such as on a display or housing) of an imaging device.

Similarly, an alignment circuit to permit determination of proper insertion of the colorant container in the fill port responsive to detection of the presence of the colorant container in the fill port. For instance, a controller (not illustrated in FIG. 3) may include instructions executable to detect, via an alignment circuit, that a colorant container is properly inserted in a fill port of an imaging device based on an amount of voltage of a clock signal (represented by element identifier 323) passing through the alignment circuit. Thus, if the amount of voltage is greater than a threshold amount of voltage the controller may determine that the colorant container is properly inserted in the fill port of the imaging device. However, if the amount of voltage is less than a threshold amount of voltage the controller may determine that the colorant container is improperly inserted in the fill port of the imaging device. The threshold may vary, for instance depending on a resistance (e.g., 2000 ohms, 200 ohms, etc.) of the alignment circuit and/or based on a type of alignment circuit (e.g., a bias resistor a ground loop-back circuit, etc.), among other possibilities. As used herein, while some examples are described in terms of a "voltage" it is understood that a "current" could be used in addition to or in place of the "voltage". Similarly, while some examples described herein are described in terms of a "current" it is understood that a "voltage" could be used in addition to or in place of the "current".

Figure 4:
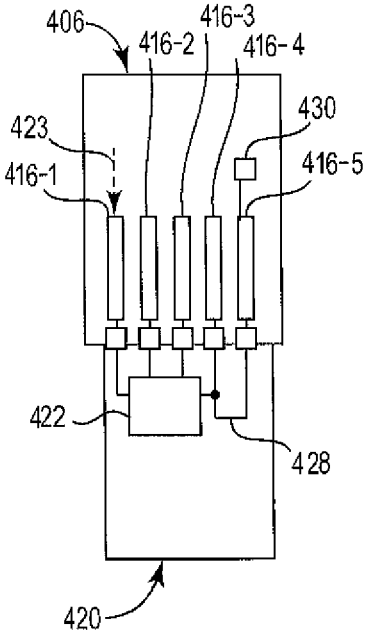
FIG. 4 illustrates yet another example of an alignment circuit consistent with the disclosure.

FIG. 4 illustrates yet another example of an alignment circuit consistent with the disclosure. Fill port 406 may be analogous or similar to fill ports 106, 206, 306 as described herein with respect to FIGS. 1, 2, and 3. For instance, the fill port 406 may include a plurality of contacts 416-1, 416-2, 416-3, 416-4, 416-5 (referred to collectively as contacts 416).

As illustrated in FIG. 4, in some examples an alignment circuit may include a ground loop-back circuit 428 coupled to a colorant container acumen 422 in a colorant container 420. As used herein, the term "ground loop-back circuit" refers to a circuit loop between two points of a circuit both intended to be at ground reference potential and yet may have a non-zero potential between the two points to permit the current and/or voltage to be determined as described herein. For instance, as illustrated in FIG. 4, the ground loop-back circuit 428 may be located between a first point such as electrical contact 416-4 and a second point such as electrical contact 416-5. The ground loop-back circuit 428 may have a predetermined resistance (e.g., 200 ohms) of any suitable value to promote alignment circuits, as described herein.

Although not illustrated in FIG. 4 for clarity and so as not to obscure examples of the disclosure, fill port 406 may be electrically connected to a switch such as those described herein. In the example illustrated in FIG. 4, the switch may be in a closed state. In other words, current may flow between the electrical contact 416-1, a ground loop-back circuit 428, electrical contact 416-4, and the switch. In the closed state illustrated in FIG. 4, a controller (e.g., controller 104 and/or controller 504 described in connection with FIGS. 1 and 5, respectively) may determine that the fill port 406 is in a closed state via a colorant container 420 being connected to the fill port 406. That is, a detection circuit to permit detection, via a switch, of a presence of a colorant container in the fill port of an imaging device.

Similarly, an alignment circuit to permit determination of proper insertion of the colorant container in the fill port responsive to detection of the presence of the colorant container in the fill port. For instance, a controller (not illustrated in FIG. 4) may include instructions executable to detect, via an alignment circuit, that a colorant container is properly inserted in a fill port of an imaging device based on an amount of current of a clock signal (represented by element identifier 423) passing through the alignment circuit. Thus, if the amount of current is greater than a threshold amount of current the controller may determine that the colorant container is properly inserted in the fill port of the imaging device. However, if the amount of current is less than a threshold amount of current, the controller may determine that the colorant container is improperly inserted in the fill port of the imaging device. The threshold may vary, for instance depending on a resistance (e.g., 2000 ohms, 200 ohms, etc.) of the alignment circuit and/or based on a type of alignment circuit (e.g., a bias resistor a ground loop-back circuit, etc.), among other possibilities.

In some examples, the ground loop-back circuit 428 may be coupled to a visual indicator 430. For instance, the visual indicator may be a light emitting diode (LED) or other type of visual indictor. In such examples, the ground loop-back circuit 428 may provide a visual indication, via the visual indicator 430, if a current is passing through the ground loop-back circuit 428. For instance, the visual indicator may provide a visual indication (by emission of visual light) if an amount of current is greater than the threshold amount of current and/or voltage. Such visual indications may provide visual feedback to a user that a colorant container is properly positioned in a fill port. In some examples, alignment circuits such as those described with respect to FIGS. 2 and 3 may include a visual indicator such as an LED. For instance, a visual indicator could be placed in series and/or in parallel with the bias resistor, among other possibilities.

Figure 5:
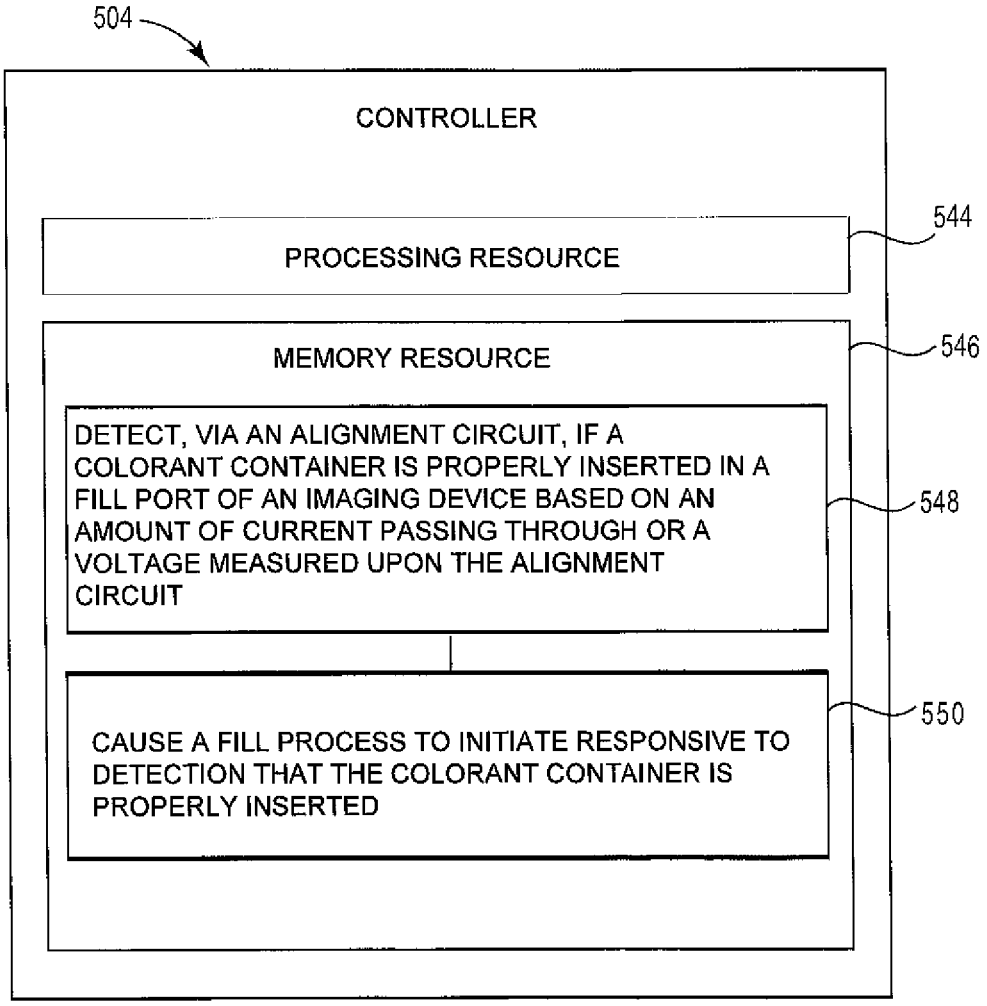
FIG. 5 illustrates an example of a controller consistent with the disclosure.

FIG. 5 illustrates an example of a controller 504 consistent with the disclosure. As illustrated in FIG. 5, the controller 504 may include a processing resource 544 and a memory resource 546. As used herein, the processing resource 544 may be a central processing unit (CPU), a semiconductor-based microprocessor, and/or other hardware devices suitable for retrieval and execution of instructions stored in non-transitory computer readable medium (e.g., the memory resource 546). The processing resource 544 may fetch, decode, and execute instructions 548, 550. As an alternative or in addition to retrieving and executing instructions, the processing resource 544 may include an electronic circuit that includes electronic components for performing the functionality of instructions. As used herein, the memory resource 546 may also be referred to as a non-transitory computer readable medium, and may be a volatile memory (e.g., RAM, DRAM, SRAM, EPROM, EEPROM, etc.) and/or non-volatile memory (e.g., a HDD, a storage volume, data storage, etc.) Although the following descriptions refer to an individual processor and an individual memory, the descriptions may also apply to a system with multiple processors and multiple memories. In such examples, the instructions may be distributed (e.g., stored) across multiple memories and the instructions may be distributed (e.g., executed by) across multiple processors.

For instance, the controller 504 may include instructions 548 stored in the memory resource 546 and executable by the processing resource 544 to detect, via an alignment circuit, that a colorant container is properly inserted in a fill port of an imaging device based on an amount of current of the clock signal passing through the alignment circuit. Thus, if the amount of current is greater than a threshold amount of current, the controller 504 may determine that the colorant container is properly inserted in the fill port of the imaging device. However, if the amount of current is less than a threshold amount of current the controller 504 may determine that the colorant container is improperly inserted in the fill port of the imaging device. The threshold may vary, for instance depending on a resistance (e.g., 2000 ohms, 200 ohms, etc.) of the alignment circuit and/or based on a type of alignment circuit (e.g., a bias resistor a ground loop-back circuit, etc.), among other possibilities.

The controller 504 may include instructions 548 stored in the memory resource 546 and executable by the processing resource 544 to cause a fill process to initiate responsive to detection that the colorant container is properly inserted. For instance, the controller may send, cease, or maintain a signal to cause a pump included in the imaging device to actuate. Similarly, in some examples, the controller 504 may include instructions 548 stored in the memory resource 546 and executable by the processing resource 544 to cause a fill process to terminate responsive to detection that the colorant container is improperly inserted. For instance, the controller may send, cease, or maintain a signal to cause a pump included in the imaging device to cease actuation. Such initiation and/or termination of a fill process responsive to detection that the colorant container is properly inserted may ensure the pump does not experience cavitation.

In some examples, the controller 504 may include instructions stored in the memory resource 546 and executable by the processing resource 544 to determine whether the fill port is open or closed, as described herein. That is, processing resource 544 may execute instructions stored in the memory resource 546 to determine, based on the state of a switch included in the detection circuit, whether the fill port is open or closed. When the switch is in an open state, controller 504 may determine that the fill port is open. For example, a user may have removed a fill port cover to fill or refill a reservoir connected to the fill port with print substance. When the switch is in a closed state, the controller 504 may determine that the fill port is closed.

In some examples, the controller 504 may include instructions stored in the memory resource 546 and executable by the processing resource 544 to determine a status of the fill port. That is, processing resource 544 may execute instructions stored in the memory resource 546 to determine, based on the state of the switch indicating the fill port is closed, a status of the fill port. The status of the fill port may indicate how the fill port is closed. For example, the fill port may be closed via a fill port cover or via a colorant container. Therefore, the fill port status may refer to the fill port being closed via the fill port cover or being closed via the colorant container.

In some examples, the controller 504 may include instructions stored in the memory resource 546 and executable by the processing resource 544 to determine whether the fill port is connected to a colorant container. That is, processing resource 544 may execute instructions stored in the memory resource 546 to, in response to the status of the fill port being closed, determine based on a voltage of the signal whether the fill port is connected to a colorant container. For example, controller 504 may determine whether the fill port is connected to a colorant container by determining the voltage of the signal. If controller 504 determines the voltage of the signal (e.g., as taken across the colorant container acumen between electrical contacts 216-1 and 216-4 as illustrated in FIG. 2) to be a first voltage (e.g., 0V), controller 504 may determine that a colorant container is connected to the fill port.

In some examples, the controller 504 may include further instructions stored in the memory resource 546 and executable by the processing resource 544 to determine whether the fill port is connected to a fill port cover. For example, controller 504 may determine whether the fill port is connected to a fill port cover by determining the voltage of the signal. If controller 504 determines the voltage of the signal to be a second voltage ((e.g., 3.3V) between electrical contacts 216-1 and 216-2), then controller 504 may determine that a fill port cover is connected to the fill port or to be a third voltage ((e.g., 3.3V) between electrical contacts 216-1 and 216-4 as illustrated in FIGS. 2 or between electrical contacts 416-4 and 416-5 as illustrated in FIG. 3)) that a colorant container is properly connected to the fill port.

Controller 504 may determine that a fill port is closed via a colorant container in response to the voltage of the signal being a first voltage. For example, controller 504 may measure the voltage of the signal to be 0 volts (V). Based on the voltage of the signal being 0V, controller 504 may determine that fill port has a colorant container connected thereto.

As described above, the first voltage may be a predetermined voltage (e.g., 0V) which may indicate that a colorant container is connected to a fill port. Although the first voltage is described above as being 0V, examples of the disclosure are not so limited. For example, the first voltage may be any other predetermined voltage. For example, the first voltage may be 1V, or a voltage less than 1V or higher than 1V.

In some examples, a detection circuit may include a pull-down resistor (not illustrated). For example, pull-down resistor may cause the current and/or voltage of the signal of imaging device to be the predetermined first current and/or voltage when the colorant container is connected to and covering a fill port. For example, a pull-down resistor may cause the voltage of the signal of imaging device to be the first voltage of 0V when the colorant container is connected to and covering a fill port. In some examples, a pull-down resistor may be a 10K ohm resistor. However, the resistance may be varied (by changing a physical resistor to another resistor or otherwise) to a resistance greater than 10K ohms (e.g., 11K ohms) or a resistor lower than 10K ohms (e.g., 9K ohms), among other possibilities.

Controller 504 may determine that a fill port is closed via a fill port cover in response to the voltage of the signal being a second current and/or voltage. For example, controller 504 may measure the voltage of the signal to be 3.3V. For example, pull-down resistor (not illustrated) may cause the voltage of the signal to be 3.3V if a fill port cover is connected to and covering a fill port. Based on the voltage of the signal being 3.3V, controller 504 may determine that fill port has a fill port cover connected thereto.

The second current and/or voltage may be a predetermined current and/or voltage (e.g., 3.3V) that may indicate that a fill port cover is connected to a fill port. Accordingly, a visual indicator such as those described herein may emit light at a predetermined intensity corresponding to the predetermined current and/or voltage to indicate the fill port cover is connect to a fill port. Although the second voltage is described above as being 3.3V, examples of the disclosure are not so limited. For example, the second current and/or voltage may be any other predetermined voltage. For example, the second current and/or voltage may be 2V, or a voltage less than 2V or higher than 2V, among other possibilities. For instance, a resistor included in a colorant container may have a different resistance value (e.g., 2K Ohms) as compared to a resistance value (e.g., 3.3K Ohms) of a resistor included in a fill port cover. In such examples, a visual indicator may emit different intensities of light whether the fill port cover or the resistor in the colorant container is connected to the fill port. For instance, the visual indicator may emit a more intense light if the colorant container is connected to the fill port as compared to a less intense light if the port cover is connected to the fill port.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. Similar elements or components between different figures may be identified by the use of similar digits. For example, 104 may reference element "04" in FIG. 1, and a similar element may be referenced as 504 in FIG. 5. Elements illustrated in the various figures herein may be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. As used herein, "a plurality of" an element and/or feature may refer to more than one of such elements and/or features.

The above specification, examples and data provide a description of the method and applications and use of the system and method of the present disclosure. Since many examples may be made without departing from the spirit and scope of the system and method of the present disclosure, this specification merely sets forth some of the many possible example configurations and implementations.

What is claimed:

1. An imaging device comprising:

a fill port to receive a colorant container including an alignment circuit;

a controller including a processing resource and memory resource including a non-transitory computer-readable instructions executable by the processing resource to:

detect a presence of a colorant container in a fill port of an imaging device;

responsive to detection of the colorant container in the fill port, detect if the colorant container is properly inserted in the fill port; and cause a fill process to initiate responsive to detection that the colorant container is properly inserted.

2. The imaging device of claim 1, further comprising instructions to determine the colorant container is properly inserted if a determined amount of current or voltage is above a threshold current or voltage for a predetermined amount of time.

3. The imaging device of claim 1, further comprising instructions to determine the colorant container is improperly inserted if a determined amount of current or voltage is above a threshold current or voltage for less than a predetermined amount of time.

4. A non-transitory computer-readable medium storing instructions executable by a processing resource to:

detect, via an alignment circuit, if a colorant container is properly inserted in a fill port of an imaging device based on an amount of current passing through or a voltage measured upon the alignment circuit; and cause a fill process to initiate responsive to detection if the colorant container is properly inserted.

5. The medium of claim 4, wherein the alignment circuit is formed of a resistive element, and wherein the instructions include instructions to determine that that colorant container is properly inserted if an amount of current passing through or a voltage measured upon the resistive element exceeds a threshold amount of current or voltage, respectively.

6. The medium of claim 5, wherein the instructions include instructions to permit determination that that colorant container is improperly inserted in the fill port if the amount of current passing through the resistive element or a voltage measured is below the threshold amount of current or voltage for a threshold amount of time.

7. The medium of claim 6, further comprising instructions to cause a pump included in imaging device to cease actuation or remain inactive responsive to detection the colorant container is improperly inserted.

8. The medium of claim 6, further comprising instructions to cause a pump included in the imaging device to actuate or remain active responsive to detection that the colorant container is properly inserted.

9. An alignment system comprising:

a detection circuit to permit detection, via a switch, of a presence of colorant container in a fill port of an imaging device; and an alignment circuit to permit determination of proper insertion of the colorant container in the fill port responsive to detection of the presence of the colorant container in the fill port.

10. The alignment system of claim 9, wherein the alignment circuit is included in the colorant container, and wherein the detection circuit is included in the imaging device.

11. The alignment system of claim 10, wherein the alignment circuit includes a bias resistor coupled to a colorant container acumen.

12. The alignment system of claim 11, wherein the bias resistor is coupled to a light emitting diode (LED) that is to illuminate in response to proper insertion of the colorant container in the fill port.

13. The alignment system of claim 10, wherein the alignment circuit includes a ground loop-back circuit coupled to a colorant container acumen.

14. The alignment system of claim 13, wherein the ground loop-back circuit is coupled to a light emitting diode (LED) that is to illuminate if the colorant container is properly inserted in the fill port.

15. The alignment system of claim 10, wherein the switch is an electro-mechanical position switch that may interrupt an electrical current.

* * * * *